US011958658B1

(12) United States Patent
Morris

(10) Patent No.: US 11,958,658 B1
(45) Date of Patent: Apr. 16, 2024

(54) FLAT PACKAGING AND PACKAGING METHODS

(71) Applicant: Foldables LLC, Arden Hills, MN (US)

(72) Inventor: Joel Orrie Morris, Arden Hills, MN (US)

( * ) Notice: Subject to any disclaimer, the term of this patent is extended or adjusted under 35 U.S.C. 154(b) by 12 days.

(21) Appl. No.: 17/154,940

(22) Filed: Jan. 21, 2021

Related U.S. Application Data

(60) Provisional application No. 62/964,158, filed on Jan. 22, 2020.

(51) Int. Cl.
*B65D 27/00* (2006.01)
*B65D 71/06* (2006.01)
*B65D 75/44* (2006.01)

(52) U.S. Cl.
CPC ..... *B65D 27/00* (2013.01); *B65D 71/06* (2013.01); *B65D 75/44* (2013.01); *B65D 2203/12* (2013.01)

(58) Field of Classification Search
CPC .... B65D 2203/12; B65D 75/44; B65D 71/06; B65D 27/00
USPC ..... 229/75
See application file for complete search history.

(56) References Cited

U.S. PATENT DOCUMENTS 3,094,791 A * 6/1963 Thiebes ..... A63F 9/06 434/96
3,316,669 A * 5/1967 Nachbar ..... G09B 1/06 D19/27
3,518,785 A 7/1970 Behr
3,666,607 A 5/1972 Weissman
4,176,473 A * 12/1979 Rae ..... G09B 1/00 446/147
4,214,404 A 7/1980 Fisher
4,502,596 A 3/1985 Saetre et al.
4,778,392 A 10/1988 Mitchell
4,798,317 A * 1/1989 Lonczak ..... A63H 33/16 446/388
4,919,982 A 4/1990 Hayes
5,010,669 A 4/1991 Moran
5,021,020 A * 6/1991 Hambly ..... A63H 3/52 446/73
5,332,093 A * 7/1994 Littlepage ..... A45C 9/00 446/268
5,458,521 A 10/1995 Todd
(Continued)

OTHER PUBLICATIONS

"Two Axis Joint to Download and Make," Sep. 29, 2011, 4 pages. Retrieved from internet: www.robives.com/blog/twoaxis on Feb. 9, 2016.

(Continued)

*Primary Examiner* — Peter N Helvey
(74) *Attorney, Agent, or Firm* — Bailiwick Law

(57) ABSTRACT

Flat packaging and packaging methods for sheet products. The sheet includes interconnected panels including a first cover panel comprising a first surface printed with information and/or images related to a product and one or more product panels, each product panel comprising one or more product components comprising the entire panels or configured to be removed from the product panels for use as the product. The cover panel and product panels are connected by fold lines between the panels the panels are configured to form a stacked formation when folded at the fold lines with the first surface of the first panel facing outward.

10 Claims, 11 Drawing Sheets

(56) References Cited

U.S. PATENT DOCUMENTS

| | | | | |
|---|---|---|---|---|
| 5,683,112 | A * | 11/1997 | McQueeny | A63H 33/38 281/31 |
| 6,120,344 | A | 9/2000 | Brown | |
| 6,136,400 | A | 10/2000 | Ktayose | |
| 6,206,699 | B1 * | 3/2001 | D'Andrea | G09B 11/04 434/428 |
| 6,626,111 | B2 | 9/2003 | Hirsch | |
| 6,782,128 | B1 | 8/2004 | Rinehart | |
| 7,654,441 | B2 | 2/2010 | Billen | |
| 7,727,045 | B2 | 6/2010 | Yasui | |
| 7,789,233 | B2 | 9/2010 | Levy et al. | |
| 9,339,735 | B2 | 5/2016 | Morris | |
| 10,905,965 | B2 * | 2/2021 | Song | A63H 3/08 |
| 2002/0092215 | A1 * | 7/2002 | Fernandez | A47G 1/141 40/765 |
| 2002/0127944 | A1 | 9/2002 | Spector | |
| 2003/0205489 | A1 | 11/2003 | Shumake et al. | |
| 2004/0166765 | A1 | 8/2004 | Martin | |
| 2005/0277358 | A1 * | 12/2005 | Isenberg | A63H 3/08 446/147 |
| 2006/0219764 | A1 | 10/2006 | Copeman | |
| 2009/0066817 | A1 | 3/2009 | Sakamaki | |
| 2009/0132371 | A1 | 5/2009 | Strietzel | |
| 2011/0248493 | A1 | 10/2011 | Aronstein | |
| 2012/0313926 | A1 | 12/2012 | Rolleston | |
| 2016/0297229 | A1 * | 10/2016 | Matyushenkova | B42D 1/007 |
| 2017/0118357 | A1 | 4/2017 | Morris | |
| 2020/0270051 | A1 * | 8/2020 | Greaves | B65D 81/368 |

OTHER PUBLICATIONS

Cory Doctorow, "Poplocks and Paper Pose-Ables: papercraft joints for pose-able robots," Mar. 16, 2013, 5 pages. Retrived from internet: www.boingboing.net/2013/03/16/poplocks-and-paper-pose-ables.html on Feb. 9, 2016.

* cited by examiner

FLAT PACKAGING AND PACKAGING METHODS

BACKGROUND

Flat products may be sold to consumers in packages such as envelopes or flat bags that may be transparent. This packaging method is particularly common for flat or thin products, which may be stacked or hung from a display peg. When transparent packages are used, one or more slips of paper which describe the product may be included in the transparent package along with the product. For example, one sheet of paper may be in front of the product forming a front cover, and a second sheet of paper may be behind the product forming a back cover. Alternatively, a single sheet of paper may be folded back on itself at the bottom of the package, forming both the front and the back covers with the product located between them.

The cover sheets may include general information to identify and market the product, such as the product name, description and images. For such product covers, having only general information, it may be easy to insert the correct cover sheets and the corresponding product when packaging the product for sale. However, in other cases, the cover sheets may include information which varies and is specific to one or more particular individual products, such as information related to the product production lot. Personalized products may also require unique matching covers. In such cases, the cover sheets must match the product, and use of the correct cover sheet with the corresponding product is more difficult. It is easy for mistakes to occur in such situations, with cover sheets including product information which is incorrect for the product with which it is packaged.

SUMMARY

Various embodiments include products in sheets of interconnected panels. The sheet of interconnected panels may include a first cover panel comprising a first surface printed with information and/or images related to a product and one or more product panels, each product panel comprising one or more product components comprising the entire panels or configured to be removed from the product panels for use as the product. The cover panel and product panels may be connected by fold lines between the panels and the panels may be configured to form a stacked formation when folded at the fold lines with the first surface of the first panel facing outward. The sheet may further include a second cover panel. The first surface of the first cover panel and/or the first surface of the second cover panel may be printed with product identifying information and/or images. One or more of the product components may be printed with the same product identifying information as the first surface of the first and/or second cover panels. Such product identifying information may be a date, a lot number or a recipient's name and/or address, for example. The one or more of the fold lines may include a cut line between adjacent panels wherein the adjacent panels remain connected by one or more tabs at the fold lines.

In some embodiments, first surface of the first cover panel and the first surface of the second cover panel are both printed with product identifying information and/or images. the panels may be configured to form a stacked formation when folded at the fold lines with the first surface of the first cover panel facing outward on a top side and the first surface of the second cover panel facing outward on a bottom side of the stacked formation.

In various embodiments, a method of packaging a sheet product includes the steps of removing one or more sheets of interconnected panels from a carrier sheet. The sheets of interconnected panels may include a first cover panel having a first surface printed with information and/or images related to a product and one or more product panels, each product panel having one or more product components comprising the entire product panel or configured to be removed from the product panels for use as the product. The panels may be connected by fold lines between the panels, and the method may include folding the interconnected panels at the fold lines into a stacked configuration with the first surface of the first cover panel facing outward and all of the other panels stacked beneath the first panel. In some embodiments, the complete sheet product may include only one sheet of interconnected panels. The information and/or images on the first surface of the first cover panel comprises product identifying information and/or images or a recipient name and/or address.

The method may further include inserting the folded interconnected panels in the sheet configuration into a clear carrier. The clear carrier may be a clear plastic sleave or bag.

In some embodiments, the sheets of interconnected panels may further include a second cover panel having a first surface printed with information and/or images. Folding the sheets into a folded configuration may include folding the sheet such that the second cover panel is located opposite the first cover panel and facing outward with the product panels between the first and second cover panels.

The method may include securing the interconnected panels in the folded configuration. In some embodiments, the step of securing the interconnected panels in the folded configuration fully encloses the product components between the first and second cover panels.

In other embodiments, the sheet product includes one or more sheets interconnected sheets of panels, each sheet including two or more panels. The panels include one or more product panels, each product panel comprising one or more product components, the product components comprising the entire product panel or a portion of the product panel configured to be removed from the product panel for use as the product alone or in combination with other product components. The panels further include a first cover panel comprising a first surface printed with information related to a product, the information comprising a legally required disclosure regarding the product or information identifying a name or address of a recipient of the product. The panels of each sheet may be connected by fold lines between the panels and the panels may be configured to form a stacked formation when folded at the fold lines with the first surface of the first surface of the first cover panel facing outward. In some embodiments, the sheet product also includes a second a second cover panel having a first surface and the panels are configured to form a stacked formation when folded at the fold lines with the first surface of the first surface of the second cover panel facing outward.

BRIEF DESCRIPTION OF THE DRAWINGS

The following drawings are illustrative of particular embodiments and do not limit the scope of the inventions. The drawings are not necessarily to scale and are intended for use in conjunction with the following detailed description. Embodiments of the inventions will be described with reference to the drawings, in which like numerals may represent like elements.

DETAILED DESCRIPTION

Figure 1:
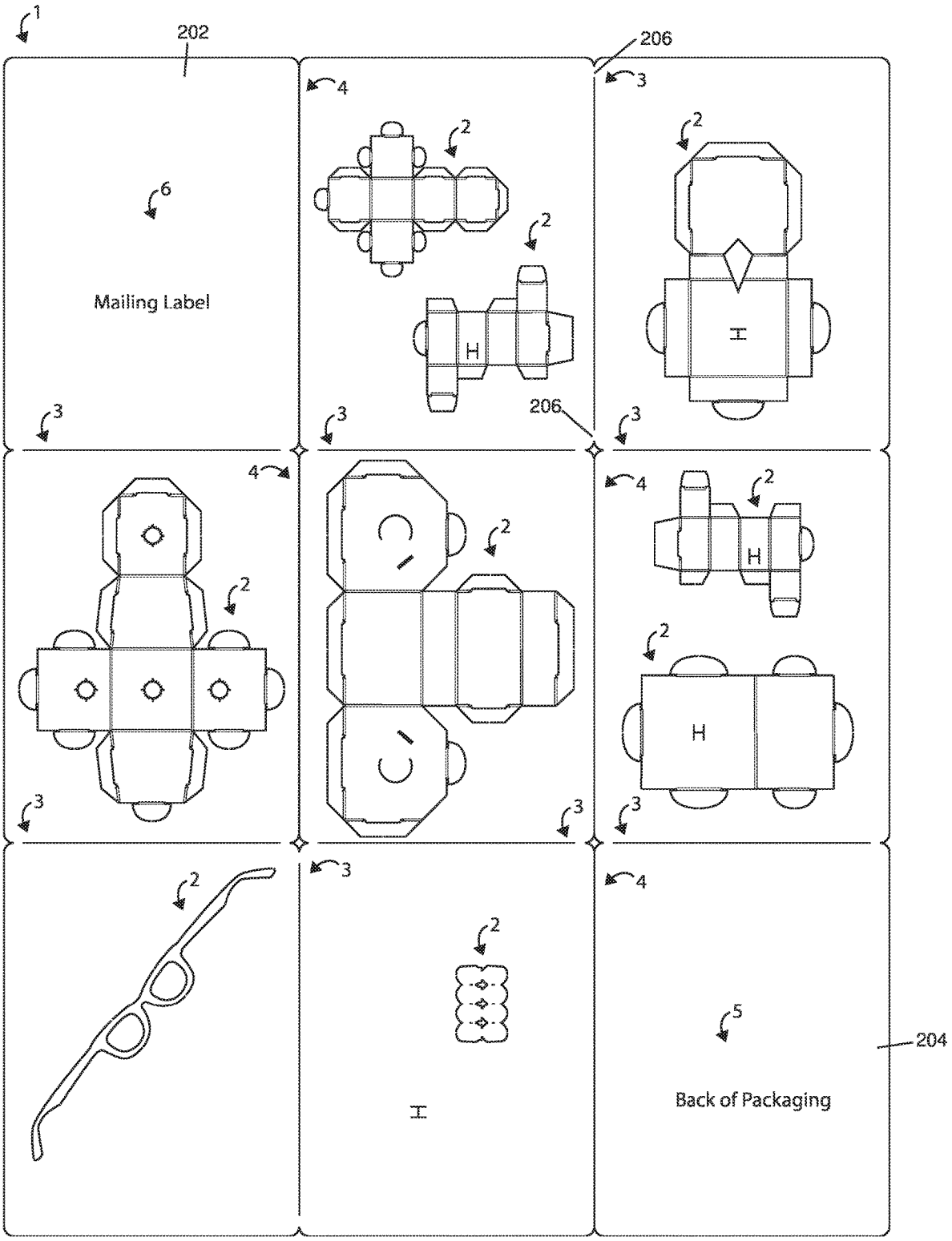
FIG. 1 is a first side of a sheet of panels including a product and covers according to various embodiments.

Embodiments of the invention include packaging systems and packaging methods for products having a sheet structure, such as products made from paper materials. The products may be provided as a single sheet or a plurality of sheets which are folded to include a front and/or back cover as well as the product or portions of the product on the same sheet. Because the cover(s) and the product are formed from the same sheet and are therefore connected to each other, there can be no mismatch between the cover(s) and the product. The folded product sheets with front and back covers may be provided in a transparent outer package, or the front and back covers may form the outside of the package.

The products may be constructed of paper sheets, particularly paper sheets having increased thickness such as cardstock. Examples of such products include toys and other items which may be provided in flat sheets and which a user may fold into three dimensional shapes. Some such examples are disclosed in U.S. Pat. No. 9,339,735, Three Dimensional Folded Figures With Rotating Joints, the full disclosure of which is hereby incorporated by reference.

In various embodiments, the sheet may include multiple interconnected panels, such as 2, 3, 4, or more panels. Some or all of the panels may include printing on one or both sides. One or two panels may be printed on one or both sides to act as the front and/or back product cover. One or more or all of the remaining panels may be, or may include within them, the product or product components and may be printed accordingly on one or both sides. In some embodiments, one or more panels may perform other functions. For example, they may be printed with product instructions on one or both sides. Which particular panels are used as cover panels, product panels, enclosure panels, or other panels or components may vary depending upon the number of panels and how the sheet is configured to be folded. The sheet itself may be a rectangular or square, though other shapes are also possible. The panels may also be rectangular or square, or in some cases may include other shapes. The panels may be interconnected along one or more edges. On a particular sheet, the panels may all be of the same size and shape to form a uniform stack when folded. However, this is not required and the panels may have a variety of sizes of shapes in some embodiments.

By incorporating the front and/or back cover of the product into the product sheet itself, rather than having separate front and/or back sheets, the cover(s) and product components are physically connected. The sheet can then be arranged by folding between the panels to expose the front face of the front cover and/or the back face of the back cover outward, with the product portion(s) of the sheet between them. In this way, it is not necessary for the front and/or back covers to be matched to the product during packaging. Production and packaging of the product is therefore less complicated and less likely to result in an error.

The risk of a mismatch between a product and a cover is particularly high when the product and cover are difficult to match, and the embodiments described herein avoid that risk. For example, for some products, there may be differences between the particular products which are not visible and/or are difficult to detect. An example of this is product production runs or lots, or products which are made on different days. In such cases, the products may all look alike and may only be distinguishable through the use of a label, for example, such as a date stamp or a lot number. It may be important, and may even be legally required, that the information on the cover(s) match the product. For example, in the case of toys, the Consumer Product Safety Commission regulations require that both the toy and the packaging be marked with a tracking label to identify the manufacturer, the date and location of manufacture, and the batch number or any other identifying characteristics. In various embodiments described herein, the information can be provided on the front and/or back cover panel portions of the sheet, as well as on the product panel portions of the sheet, to comply with these regulations. Furthermore, because the product information is provided on the packaging and the product using the same sheet, the risk of packaging a product with an inaccurate cover is avoided. Alternatively, multiple sheets may be used, for example a cover panel sheet and a product panel sheet, created from the same carrier sheet as described further below.

In other embodiments, the product may be configured to be personalized, such as to include different printed words, images, colors or other features per a request or product order from a consumer. In such cases, the personalized product must be delivered to the correct consumer, therefore there must be no mismatch between delivery details (such as consumer name and address) and the personalized product. In such embodiments, an assembly system my create personalized product sheets, one after another, with each one different, on a carrier sheet. In various embodiments described herein, the product may be provided on one or more product panels while the customer details may be provided on one or more cover panels. The product panels and cover panels may be connected, such as long fold lines, so that there is no risk of mismatch. Alternatively, the product panels may be created as one sheet while the cover panels may be created as a second sheet, both on the same carrier sheet in proximity to each other. The product panel sheet and cover panel sheet may both be cut from the same carrier sheet and folded together into a single package. In some embodiments, the product panel sheet and/or cover panel sheet may further be divided into additional sheets to be two or more product panel sheets and/or two or more cover panel sheets, or some sheets may include both product panels and cover panels and/or other panels. However, each of the sheets may be created from the same carrier sheet, at the same time and in proximity to or directly adjacent to each other, to reduce the risk of mismatch between product sheets and cover sheets during packaging.

Various embodiments described herein include sheets of foldable material such as paper products such as greeting cards which may have pop out figures. It may also be used with flat products which are not paper, such as plastic or foam-based products. In some embodiments, depending upon the nature of the product, the sheets may be somewhat thick. For example, the sheets may be a paper material such as cover, card or paperboard. In some embodiments, the paper material may be about 80 pounds or greater, such as about 80 pounds to about 130 pounds (using the industry standard measurement of pounds per ream or 500 sheets). In some embodiments, the sheet may be 12 point or greater, such as about 12 point to about 24 point. In some such cases, the sheet may be difficult to fold, particularly when it is not being folded only onto itself but rather is being folded multiple times with folds over others fold. Various embodiments may therefore provide the sheets with configurations which include partially cut or fully cut divisions between panels. When partially cut, the panels may remain connected through tabs as described later in this disclosure. A single carrier sheet, such as a large sheet or a continuous sheet roll, may be used to create all of the panels of a particular embodiment including the product panels, cover panels, and enclosure panels, such as by printing and cutting the panels out of the carrier sheet, as a single sheet or multiple sheets of interconnected panels.

In various embodiments the sheet may include 2 panels, 3 panels, 4 panels or more. When the embodiment includes 2 panels, the first panel may be a front or back cover and the second panel may be (or may include) the product. The first and second panels may be folded against each other such that the cover face of the cover panel faces outward with the product panel behind it. When the embodiment includes 3 panels, a first panel may be a font cover, a second panel may be (or may include) the product and a third panel may be the back cover. The panels may be arranged side by side and folded along the fold lines (or cut lines) between adjacent panels to expose the printed cover faces of the front and back covers with the product between them. Alternatively, a 3 panel embodiment may include either a front cover or a back cover with two product panels. When the embodiment includes 4 or more panels on a sheet, the sheet may include a front and/or back cover panel, with the remainder of the panels being or including the product or being other panels. In such cases, given the number of panels, it would be necessary to fold the sheet multiple times to stack all of the panels, such that fold lines overlie each other. Some such embodiments include the use of cut lines in place of fold lines between adjacent panels in which there is no connection between adjacent panels, which may be helpful particularly if the sheet material is thick.

Various embodiments may include fold lines only or a combination of fold lines and cut lines. In addition, in some embodiments the fold lines may be configured to assist with the folding process. In some embodiments, the fold line may be partially of completely scored or indented. In some embodiments, the fold lines may be partially cut, such as through the use of a perforated cut line having a series of dotted or dashed cuts along the fold line. In some embodiments, a large portion of the fold line may be cut, such as more than half of the cut line. For example, it may be cut along about 50% to about 98%, or about 60%-95%, or about 75-95% of the line. In some embodiments, the panel may remain attached to the adjacent panel along a fold line including cuts through one or more tabs such as one, two, three or four tabs in which the sheet material bridges from one panel to an adjacent panel. The cut lines between the tabs may be simple cuts such that the sides of the panels abut each other. Alternatively, one or more of the cut lines around and between the adjacent panels may be widened, with a thin linear strip of the sheet material cut out and removed between the adjacent panels such that they abut less or do not abut each other at all but have a narrow empty gap between them. Narrower cut lines may be used with embodiments using thinner sheet materials and/or when the panels are configured to fold over fewer other panels, for example. Wider cut lines may be used with embodiments using thicker material and/or when the panels are folded over each other more times, for example.

Figure 2:
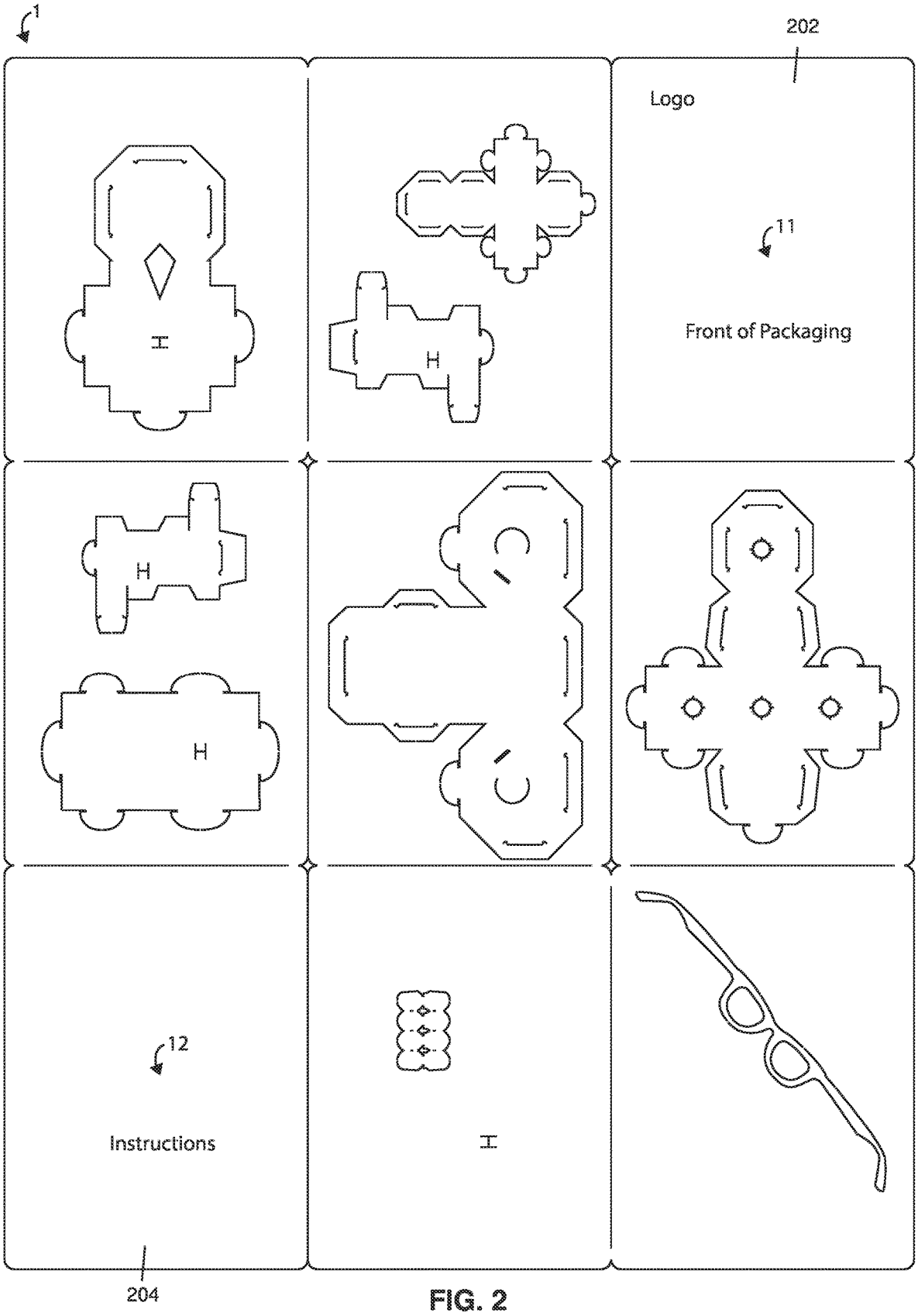
FIG. 2 is a second side of the sheet of FIG. 1.

An example according to various embodiments is shown in FIGS. 1 and 2, which depict a first and second side respectively of a sheet 1. Sheet 1, and various other sheets described herein, may have been cut from a larger carrier sheet, not shown, during production. The sheet 1 includes 9 generally rectangular panels arranged in a 3 by 3 configuration. In this example, the product included in the sheet is a foldable 3-dimensional toy, the components 2 of which are included in seven of the panels which are product panels. A user may remove the toy components 2, such as by cutting them out or punching them out along dashed or perforated lines, for example, to then fold the components and assemble them. Any other sheet like product may be included in the panels instead. In various embodiments, the product may form a portion of the product panel or the entire product panel or may include a combination of these.

In FIG. 1, the panel in upper left is a front cover panel 202 and the panel in the lower right is a back cover panel 204. In FIG. 2, which shows the reverse side of sheet 1, front panel 202 is located in the upper right and back cover panel 204 in the lower left. Front and back cover panels 202 and 204 form the covers when the product is in a folded configuration. Front cover panel 202 includes printing, such as a mailing label 6 on the first side for products sent by mail and the general wording and/or images of a cover of a package on the second side as represented by the notations Logo and Front of Packaging 11. The back cover panel 204 includes general wording and images of a back cover of a package as represented by the notation Back of Packaging 5 on the first side and instructions such as instructions for assembly and/or use of the product as represented by the word Instructions 12 on the second side. These are just examples and any other identifying, explanatory or other marks such as symbols, words or images may be used on the front cover panel and/or back cover panel.

Between some adjacent panels, the sheet is cut completely at cut lines 4. Other adjacent panels remain connected along fold lines 3, though these lines are cut through most of the length of the fold line and remain connected only at a pair of tabs 206 at each end of the fold line 3. While these tabs 206 are located at the ends of the fold lines 3, they could alternatively be located at other locations along the fold lines 3 and more or fewer tabs could be used. In some embodiments, the tabs may be perforated or creased, such as to assist with folding.

Figure 3A:
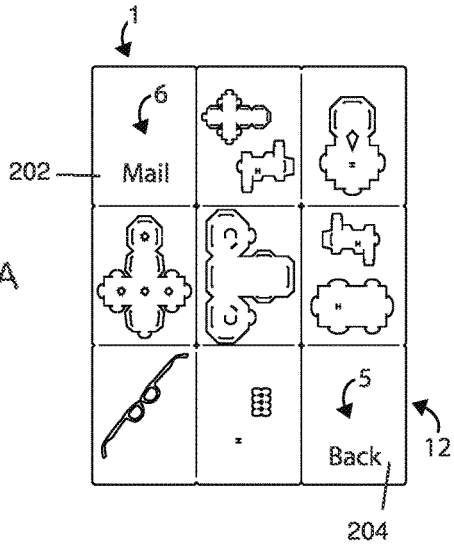
FIGS. 3A, 3B, 3C, 3D, 3E and 3F are the sheet of FIGS. 1 and 2 in step wise stages of being folded.
Figure 3B:
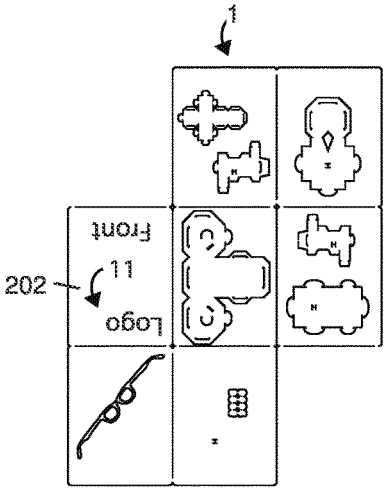
Figure 3C:
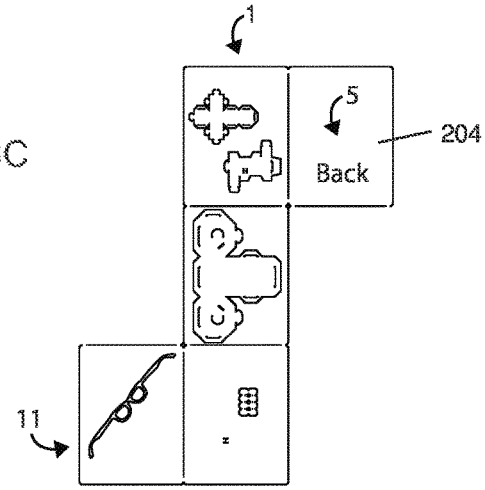
Figure 3D:
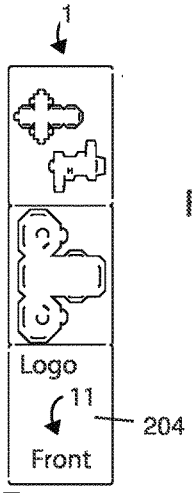
Figure 3E:
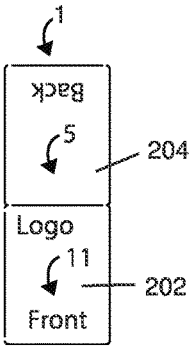
Figure 3F:
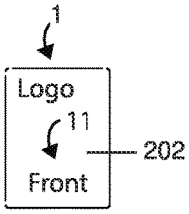
Figure 4A:
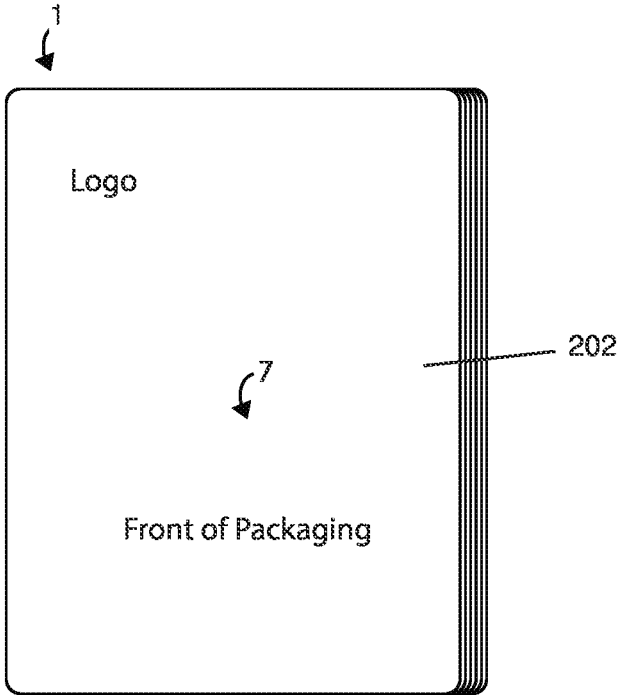
FIGS. 4A and B are the sheet of FIGS. 1-3F in a folded configuration.
Figure 4B:
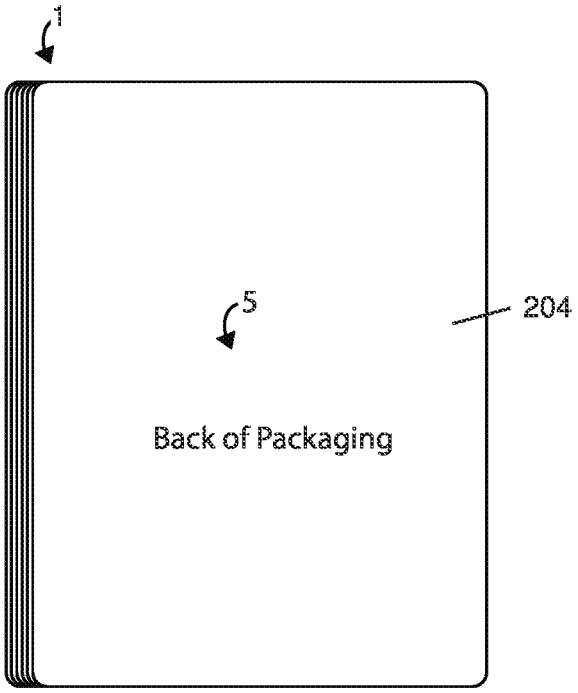

FIGS. 3A-F show the sheet 10 of FIGS. 1 and 2 as it is folded in the packaging process. In FIG. 3A, the sheet 1 is flat. The front cover panel 202 is then folded forward and the back cover panel 204 is folded backward along fold lines 3 resulting in the configuration shown in FIG. 3B. The panels are further folded and stacked in a stepwise fashion as shown in FIGS. 3C through 3E. The end result, shown in FIG. 3F, has all panels stacked on top of each other, with the front cover panel 202 facing forward to show the Front of Packaging 7 and the back cover panel 204 facing backward on the outside of the stack to show the Back of Packaging 5. This folding is possible due to the configuration of cut lines 4 and fold lines 3 and panels. This folded sheet 1 is ready for shipping and/or packing, without the need to add an identifying cover. A front view of the stacked product is shown in FIG. 4A and a back view is shown in FIG. 4B.

Figure 5:
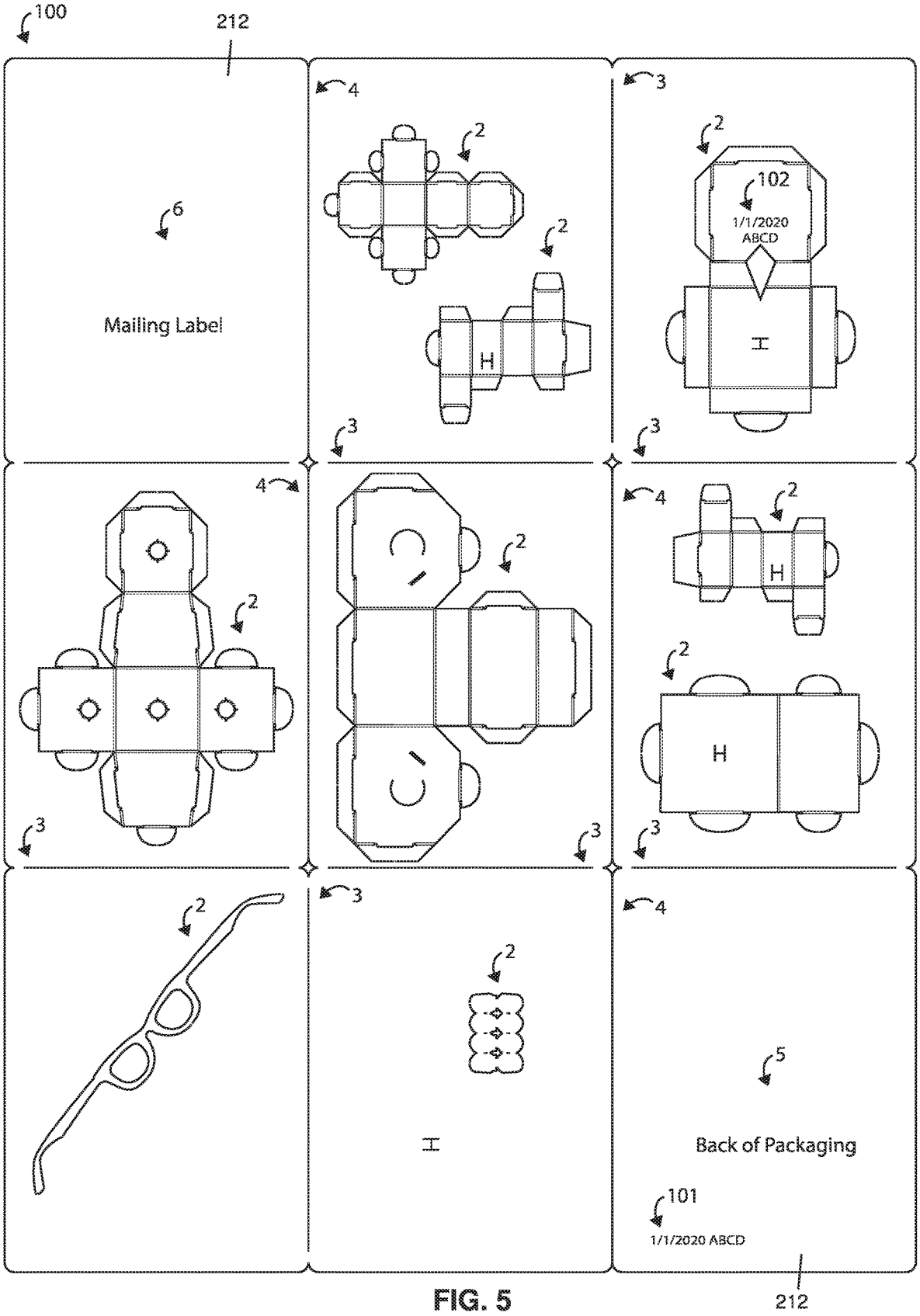
FIG. 5 is an alternative embodiment of a sheet of panels including a product and covers according to various embodiments.
Figure 6:
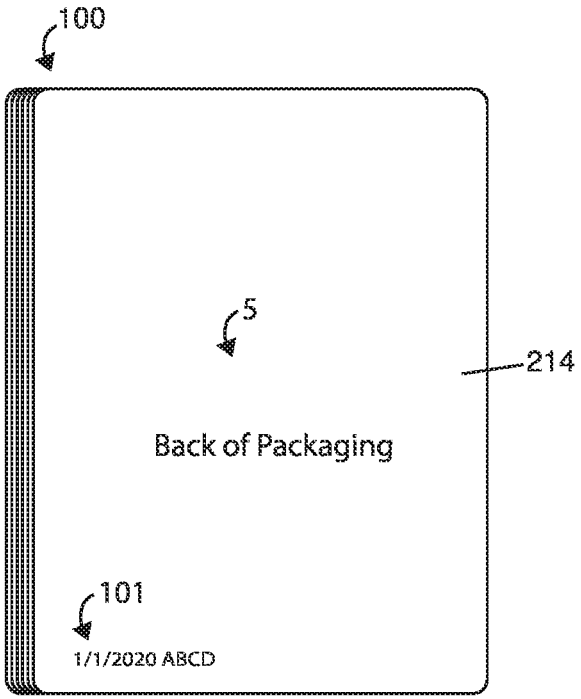
FIG. 6 is the sheet of FIG. 5 in a folded configuration.

An alternative embodiment is shown in FIG. 5. Sheet 100 includes 9 panels in a 3 by 3 arrangement and is similar to sheet 1. However, in this embodiment, sheet 100 includes manufacturing data 101 102 on both the back cover panel 214 and on the product component 2. This manufacturing data may include the production date, location, lot number, or other specific information as described above. Because the manufacturing data 101 102 on toy component 2 and on the back cover panel 214 are included in the same sheet 100, there is no need to match a cover to a product during packaging and the correct information will automatically be shown on the back cover panel 214 after the product is folded for packaging. The locations of the manufacturing data shown in this figure are just examples, and it could be provided on any product component 2 and anywhere on either the front cover panel 212 and/or the back cover panel 214 on the surfaces which face outward after folding. FIG. 6 depicts the sheet 100 after it is folded into a stacked configuration for shipping, packaging, and/or display and sale. The manufacturing data 101 faces outward on the back cover panel 214.

Figure 7:
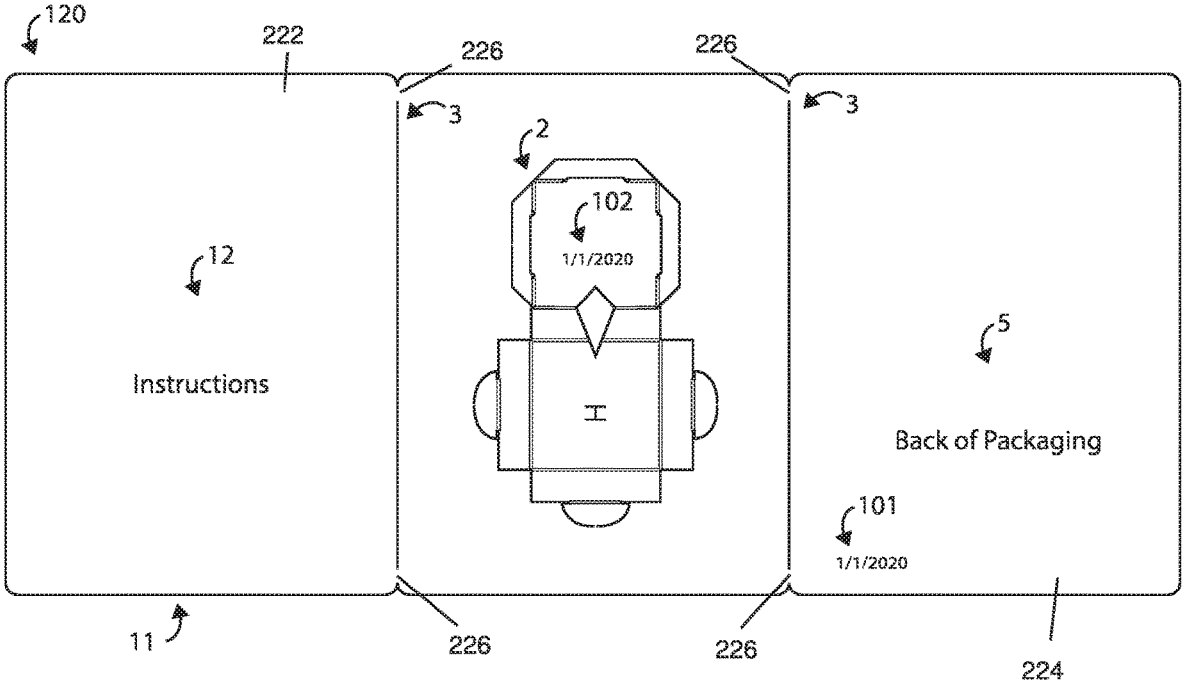
FIG. 7 is another alternative embodiment of a sheet of panels including a product and covers according to various embodiments.

Another alternative embodiment is shown in FIG. 7. In this example, the sheet 120 includes three panels arranged side by side. The sheet includes a front cover panel 222, a back cover panel 224, and a product panel between them including product component 2. Fold lines 3 lie between the panels and tabs 226 connect them. Manufacturing data 101 is located on the back cover panel 224 and matching manufacturing data 102 is located on the product component 2 in the central panel. During packaging, the sheet 120 may be folded along fold lines 3 into a Z-shape by folding the front cover panel 222 forward over the central panel and back panel cover 224 backward behind the central panel. The resulting folded sheet 120 will have the front of the packaging facing outward on the top and the back of packaging facing outward on the bottom of the folded stack, with the manufacturing information visible on the back panel cover 224. In this and the other examples and embodiments, the panels may be arranged differently and the sheet may be folded differently with the same result.

Figure 8:
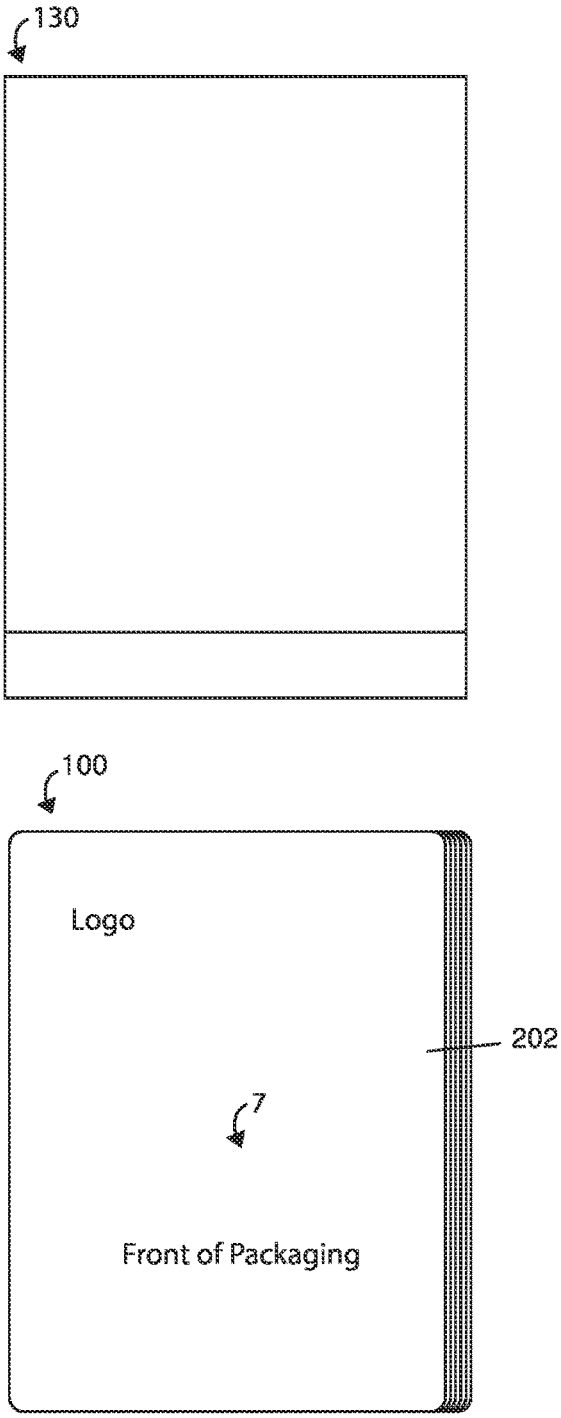
FIG. 8 is the sheet of FIG. 1 with a packaging overlay.
Figure 9:
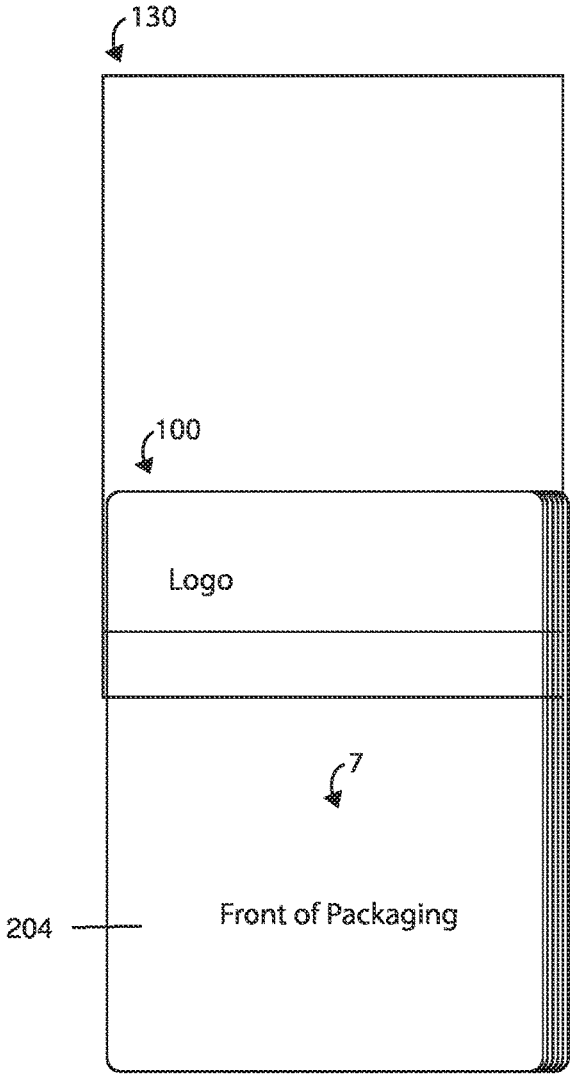
FIG. 9 is the sheet of FIG. 1 in a folded configuration partially inserted into the packaging overlay.

In some embodiments, it may be desirable to provide the stacked folded sheet in a transparent package such as a clear envelope or pouch. An example of this is shown in FIGS. 8 and 9, in which a clear envelope 130 is slid over the folded sheet 100. The front cover panel 202 with Logo and Front of Packaging 7 will be visible through the envelope 130. Such a transparent package may be used with any of the embodiments described herein, with the front and back covers visible through the package to display the manufacturing data or other specific identifying data through the package.

In still other embodiments, the panels may be configured such that the sheet may be folded to contain the product panels within a front and back panel as the final outer packaging without the use of a separate cover, pouch or envelope. A first example of this is shown in FIGS. 10-12 and a second example is shown in FIG. 13.

Figure 10:
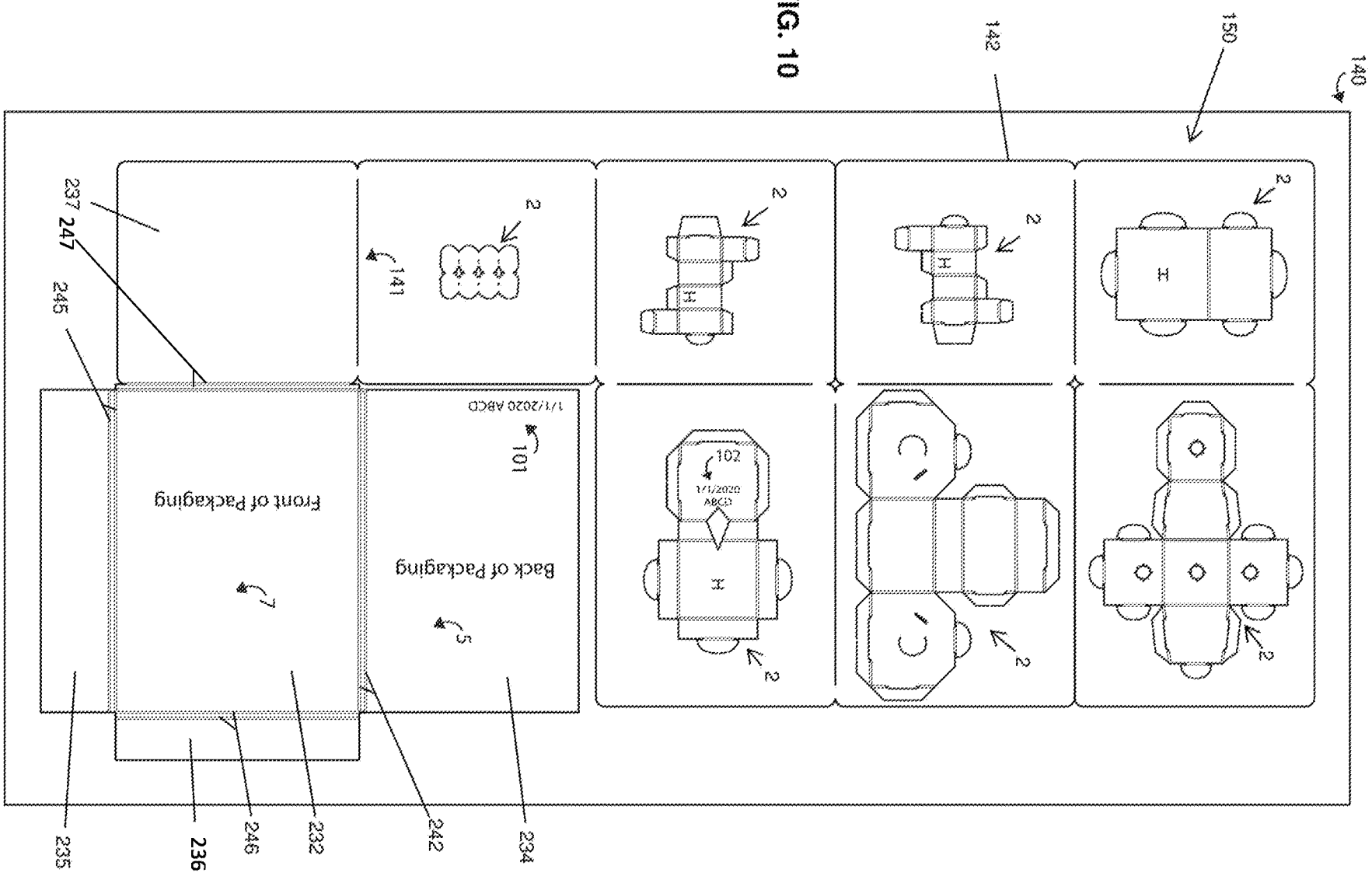
FIG. 10 a carrier sheet including sheet of a sheet of panels including a product and cover and enclosure panels according to various embodiments.

In the example shown in FIG. 10, product sheet 150 has been created within carrier sheet 140. The product sheet 150 may be removed from the carrier sheet along outer cut line 142, which extends entirely around the circumference of the product sheet 150, prior to folding for packaging and/or shipping, with all of the panels of product sheet 150 remaining interconnected after removal from the carrier sheet. Product sheet 150 includes multiple product panels each including one or more product components 2 and separated from other adjoining panels by fold lines. As in the previous examples, the fold lines may be marked lines, indentations, scored or perforated lines or cut lines including tabs, for example, or alternatively may be cut lines, provided that enough fold lines remain intact for the panels to be interconnected as a sheet. The sheet further includes a front panel 236 which functions as a front of the package when the sheet 150 is folded and a back panel 234 which functions as the back of the package when the sheet 150 is folded. The sheet 150 includes additional enclosure panels 235, 236, 237, which are used for enclosing the folded product panels in a fully enclosed space between the front panel 232 and the back panel 234. The sheet 150 is shown in a flat, unfolded form in FIG. 10, such as it would be after manufacturing (such as printing) and prior to folding for packaging.

In the example shown in FIG. 10, product sheet 150 has been created within carrier sheet 140. The product sheet 150 may be removed from the carrier sheet along outer cut line 142 which extends entirely around the circumference of the product sheet 150 prior to folding for packaging and/or shipping, with all of the panels of product sheet 150 remaining interconnected after removal from the carrier sheet. In FIGS. 11 and 12, sheet 150 has been removed from carrier sheet 140 and folded with the product panels folded in a stacked fashion between the front panel 232 and back panel 234.

Figure 11:
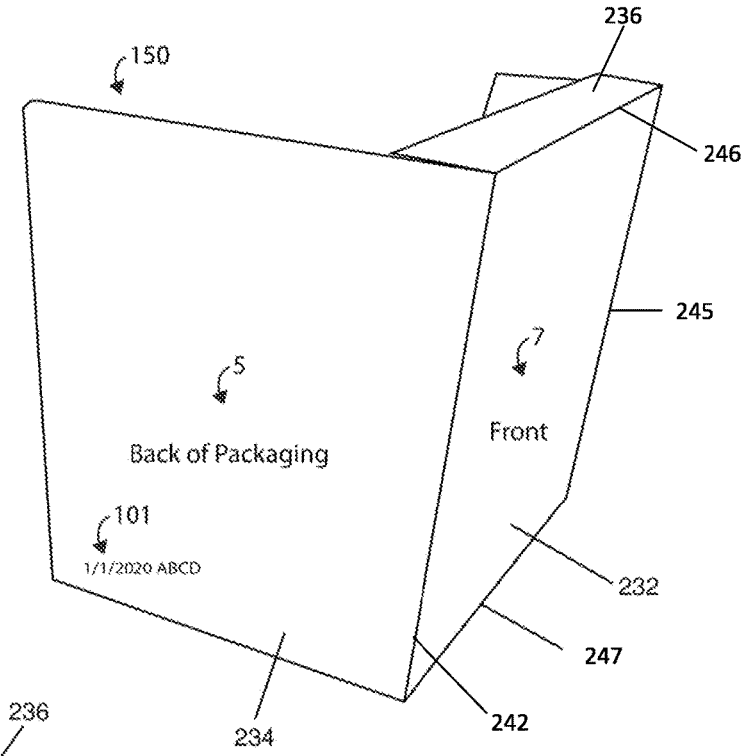
FIG. 11 is a front perspective view of the sheet of FIG. 10 in a partially folded configuration.
Figure 12:
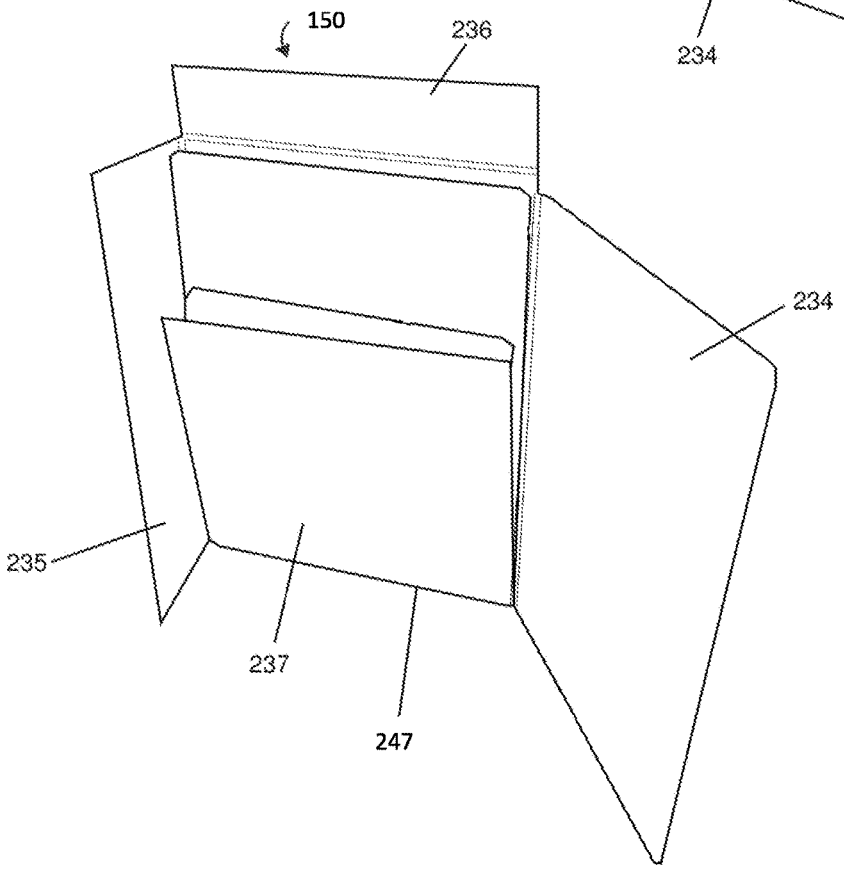
FIG. 12 is a back perspective view of the sheet of FIG. 10 in a partially folded configuration.
Figure 13:
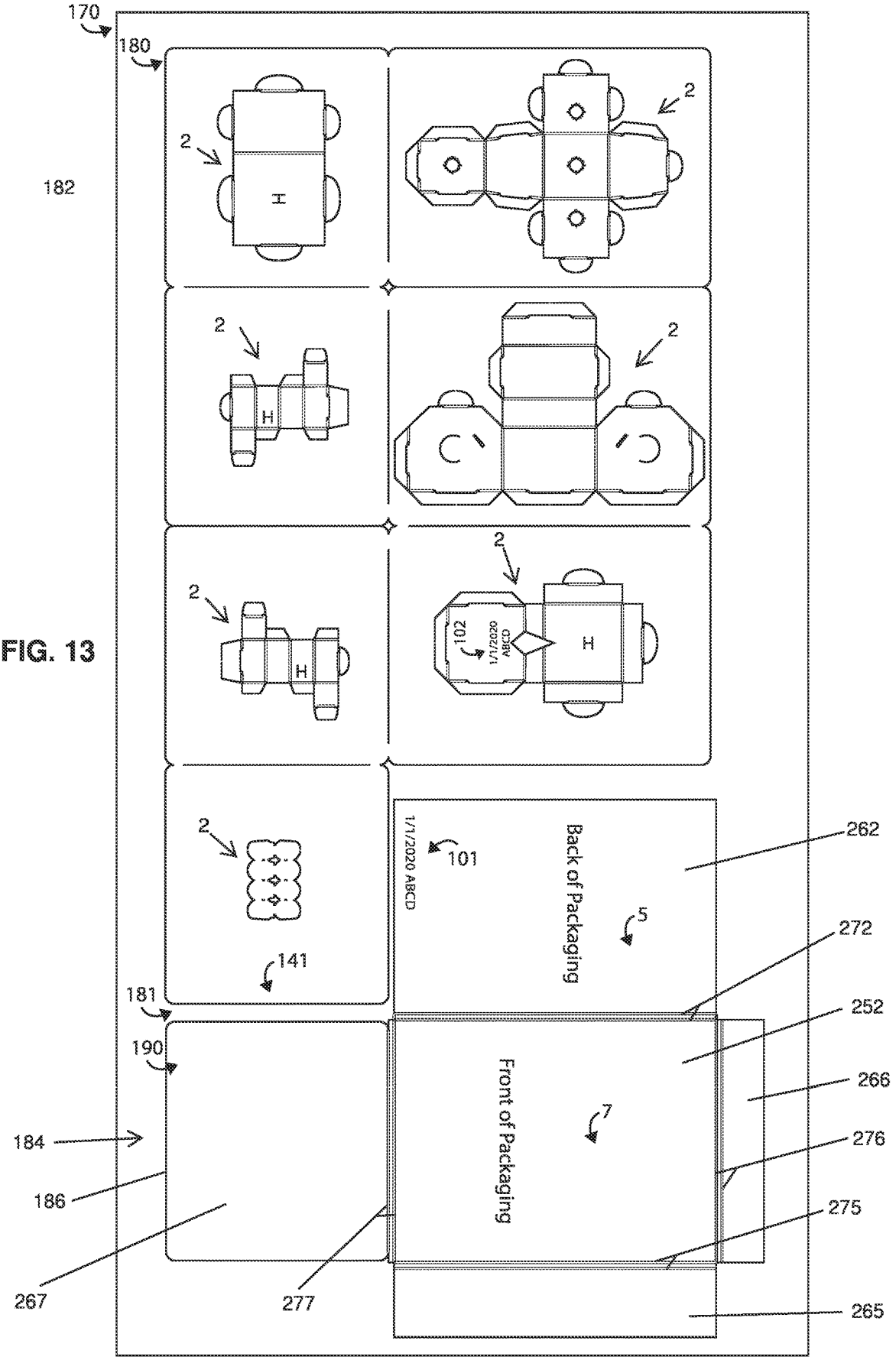
FIG. 13 is a carrier sheet including a product sheet and a packaging sheet.

FIGS. 11 and 12 show sheet 150 in a partially folded configuration from a side perspective and a back perspective respectively. The product panels have been folded against themselves along the fold lines between adjacent product panels. Enclosure panel 237 has been folded up at the edges of the stack, with the product panels folded in a stacked fashion between the front panel 232 and enclosure panel 237. Fold line 247 connects enclosure panel 237 to front panel 232. In this way, the edges of the stacked product panels are not exposed between the front panel 232 and the back panel 234 but rather the fold line 247 forms an edge of the folded package. Likewise fold line 245 between enclosure panel 235 and front panel 232, and fold line 246 between enclosure panel 236 and front of panel 232, enclose the folded stacked product panels such that their other edges are not exposed in the folded package. Fold line 242 between the front and back of the packaging forms the fourth side of the product package. In this way, fold lines 242, 245, 246 and 247 form the 4 package edges and the product panels are fully enclosed within the folded package with no edges exposed to the environment.

In FIG. 10, it can be seen that the fold lines between adjacent product panels are depicted as a single line, while fold lines 242, 245, 246 and 247 connecting to the front and back of packaging are depicted as double lines. Because fold lines 242, 245, 246 and 247 fold around multiple layers of the sheet when the product panels are folded in a stacked fashion, they must provide a fold which accommodates more space. This may be done by using 2 closely spaced parallel fold lines which are spaced apart to accommodate the stacked sheets, such that the space between the parallel fold lines is approximately equal to the depth of the stacked sheets. In this way, the sheet will bend approximately 90 degrees at each of the parallel fold lines, so that together they form an approximately 180 bend. Alternatively, a single fold line may be used to bend the sheet approximately 180 degrees at the fold line, particularly when a thinner sheet material is used and/or fewer sheets are stacked together. While other fold lines, such as those between product sheets, may accommodate folding over multiple sheets through the use of fold lines at which the sheet is cut and connected only by tabs as described previously, the use of such cut fold lines and tabs may not be desirable at the enclosure panels. Rather, it may be preferable to use fold lines which are fully intact for the enclosure panels since these fold lines form an outer enclosure of the product. In this way the product may be better protected from the environment (dirt, moisture, and other damage) such as during display or shipping.

In the alternative embodiment shown in FIG. 13, product sheet 180 and packaging sheet 184 are separate sheets which have been created within carrier sheet 170. The product sheet 180 and packaging sheet 184 may be removed from the carrier sheet 170 along outer cut lines 182 and 186 which extend entirely around the circumference of the product sheet 180 and the packaging sheet 184 respectively. After removal from the carrier sheet 170, the product sheet 180 and the packaging sheet 182 may be folded together along the fold lines between the panels such that the folded stacked panels of the product sheet are entirely surrounded by the folded enclosure of the packaging sheet panels 182 in the same manner as described above with regard to FIGS. 10-12. In this example, even though the product sheet 180 is separate from the packaging sheet 184, they are created together on the same carrier sheet 170 and thus they remain physically connected during the initial manufacturing steps, and may easily remain in close proximity to each other during subsequent folding and packing steps, to substantially reduce the risk of a mismatch between the product sheet 180 and the packaging sheet 184 in the final packaged product, particularly as compared to processes in which the product and the packaging are created separately on separate sheets.

The product and packaging described herein may be created using various methods. In some methods, the method begins with receiving instructions from a user such as a consumer for a personalized product and transferring these instructions to a production system. The instructions may be digital instructions and may be sent to the production system over the internet, for example. Alternatively, the instructions may be input into the production system directly by a user for production of multiple sheets of products which may not be personalized but which may include specific selected features (such as color, etc.) and/or other specific printed details such as lot numbers of production date.

The production system may include ordinary printer components such as printers as well as cutting components such as cutters. The specified product and associated components such as covers and enclosures may be printed, etched or stamped onto the carrier sheet, cut line and perforated or dashed lines may be cut into the product according to the user instructions and/or product specifications. The product sheet and other optional sheets may then be cut out of the carrier sheet and folded into a stacked configuration as described herein, with the cover panels on the outside. The folded and covered product may then be inserted into packaging such as a clear envelope or bag and may be sealed. Alternatively, in embodiments in which the product is fully contained by the cover and enclosure panels, it may be secured in the folded configuration and secured in this position, such as through the use of an adhesive, such as by the application of one or more pieces of tape like a clear tape or stickers or glue. The folded and contained product may then be sent to its destination. In some embodiments, such as those being sent directly to consumers, postage may be applied or printed onto the cover panel along with the consumer name and address during manufacturing such as during printing of the cover panel and the enclosed product may be sent to the consumer through the mail or through another delivery service.

In the foregoing description, the inventions have been described with reference to specific embodiments. However, it may be understood that various modifications and changes may be made without departing from the scope of the inventions.

The invention claimed is:

1. A sheet of interconnected panels comprising:

a first cover panel comprising a first surface printed with information and/or images related to a product and a plurality of edges;

a second cover panel having a first surface and a plurality of edges;

a plurality of enclosure panels, each enclosure panel comprising a plurality of edges;

a plurality of product panels, each product panel comprising a plurality of edges;

and one or more product components, the product components comprising the entire product panel or configured to be removed from the product panel for use as the product;

wherein the first and second cover panels, the plurality of enclosure panels, and the plurality of product panels are all interconnected with each other along fold lines at their edges; and wherein the first and second cover panels, the plurality of enclosure panels, and the plurality of product panels are configured to form a stacked formation when folded at the fold lines, with the first surface of the first cover panel facing outward at a top of the stacked formation and the first surface of the second cover panel facing outward at a bottom of the stacked formation to form an outer package, and with the plurality of product panels fully enclosed within the outer package with none of the product panel edges exposed.

2. The sheet of claim 1 wherein the first surface of the first cover panel and/or the first surface of the second cover panel is printed with product identifying information and/or images.

3. The sheet of claim 2 wherein one or more of the product components are printed with the same product identifying information as the first surface of the first and/or second cover panels.

4. The sheet of claim 3 wherein the product identifying information comprises a date.

5. The sheet of claim 3 wherein the product identifying information comprises a lot number.

6. The sheet of claim 2 wherein the information or images printed on the first surface of the first cover panel comprises a recipient's name and/or address.

7. The sheet of claim 2 wherein the first surface of the first cover panel and the first surface of the second cover panel are connected to each other along one of their edges, the connected edges comprising a double fold line.

8. The method of claim 1 wherein one or more of the fold lines comprises a cut line between adjacent panels wherein the adjacent panels remain connected by one or more tabs.

9. A sheet product comprising:

a plurality of product panels, each product panel comprising a plurality of edges and;

one or more product components, the product components comprising the entire product panel or a portion of the product panel configured to be removed from the product panel for use as the product alone or in combination with other product components;

a first cover panel comprising a plurality of edges and a first surface printed with information related to a product, the information comprising a legally required disclosure regarding the product or information identifying a name or address of a recipient of the product;

wherein the plurality of product panels and the first cover panel are all connected along one or more of their edges in an array comprising a plurality of columns and a plurality of rows with the connected edges comprising fold lines;

wherein the plurality of product panels and the first cover panel are configured to form a stacked formation when folded at the fold lines with the first surface of the first cover panel facing outward and all of the product panels stacked beneath and covered by the cover panel.

10. The sheet product of claim 9, wherein the sheet product further comprising a second cover panel comprising a first surface and a plurality of edges, the second cover panel connected to the first cover panel at one of their edges by a fold line, wherein when the sheet is in the stacked formation, the first surface of the second cover panel faces outward with the product panels stacked between the first cover panel and the second cover panel.

* * * * *